United States Patent [19]

Schwartz

[11] 4,095,138

[45] June 13, 1978

[54] ELECTRON GUN HAVING AN ARC-INHIBITING ELECTRODE

[75] Inventor: James W. Schwartz, Deerfield, Ill.

[73] Assignee: Zenith Radio Corporation, Glenview, Ill.

[21] Appl. No.: 745,889

[22] Filed: Nov. 29, 1976

[51] Int. Cl.[2] ..... H01J 29/46

[52] U.S. Cl. ..... 315/16

[58] Field of Search ..... 315/16 (U.S. only), 315/13 CG

[56] References Cited

U.S. PATENT DOCUMENTS

| | | | |
|---|---|---|---|
| Re. 25,127 | 2/1962 | Szegho | 315/16 |
| 3,015,752 | 1/1962 | Schrecongost | 315/16 |
| 3,049,641 | 8/1962 | Gleichauf | 315/16 X |
| 3,895,253 | 7/1975 | Schwartz et al. | 315/16 X |

*Primary Examiner*—Malcolm F. Hubler
*Attorney, Agent, or Firm*—Ralph E. Clarke

[57] ABSTRACT

Arc-inhibiting means for a television picture tube having an electron gun with a main focus lens section of the extended field type. The lens establishes an extended, axially continuously active focusing field which is substantially shielded from external field disturbances. There exist widely disparate potentials with a potential difference in the range of tens of kilovolts across the gap between a grid means of an electron source means and an initial end electrode of the main focus lens. The potential difference is sufficient to introduce a tendency toward destructive arcing between the grid means and the initial end electrode. The electron gun according to the invention is characterized by having at least one arc-inhibiting electrode disposed between the grid means and the initial end electrode, and having a potential thereon that is intermediate to the disparate potentials to provide an arc-inhibiting voltage gradient between the grid means and the initial end electrode.

1 Claim, 5 Drawing Figures

ELECTRON GUN HAVING AN ARC-INHIBITING ELECTRODE

BACKGROUND OF THE INVENTION

This invention concerns electron guns used in television picture tubes, particularly those having a unipotential-type electrostatic focus lens, and the problem of electrical arcing in such guns.

Electron guns employed in television picture tubes generally comprise two distinct sections. The first is a rear section made up successively of a thermionic cathode for emitting electrons, a control grid, and an accelerating grid for forming a beam "cross-over." The thus-formed beam enters the influence of a second section commonly called a "main focus lens." The main focus lens is comprised of two or more electrodes between which are formed electrostatic fields which serve to focus an image of the cross-over on the phosphor-bearing viewing screen of the picture tube. Also, by virtue of the potentials on the electrodes, the kinetic energy of the beam is increased.

Most electron guns comprise a series of discrete, electrically conductive discs or tubular elements contiguous to each other and aligned on a common axis. In multi-gun assemblies, each gun may comprise a series of electrically discrete electrodes, or, the electrodes of the guns which have functions in common may be physically combined, or "unitized." Each gun electrode normally may receive a voltage of a predetermined potential to establish electrostatic fields between the electrodes for forming and shaping the beam, and focusing the beam cross-over to provide small, symmetrical "spots" on the viewing screen.

A monochrome television system uses a single gun for activation of the phosphor targets on the viewing screen. Color television systems commonly make use of three guns to activate groups of red-light-emitting, green-light-emitting, and blue-light-emitting phosphors deposited in predetermined patterns on the screen. The three guns may be arranged in a trigonal configuration, or, the array may be "in-line"; that is, the guns may lie side-by-side in the same plane, with the emitted beams being coplanar.

With regard to the main focus lens, there are two types that have long been in use. The first is the two-electrode "bipotential" focus lens, which presents to electrons traveling through the main focus lens an axial potential distribution which increases monotonically from an initial low potential on an electrode adjacent to the rear section to a final high potential on an electrode nearest the viewing screen, as shown diagrammatically in FIG. 1. Because of its initial low potential, a gun having a bipotential lens has little tendency to arc between close lying, adjacent electrodes of the rear section and the main focus lens section.

A second type of main focus lens, termed the "unipotential" focus lens, also known as the Einzel, is comprised of three or more electrodes. The term unipotential refers to a lens whose axial potential distribution is substantially saddle-shaped (high-low-high) and in which the potentials on the first and last electrodes are equal. The axial potential distribution of the lens decreases monotonically from an initial relatively high potential on an electrode adjacent to the rear section, to a relatively low potential on an intermediate electrode, then increases, again monotonically to a final relatively high potential on an electrode nearest the viewing screen. The graphical contour of this potential distribution is shown by FIG. 2.

Unipotential type main focus lenses typically have the minimum three electrodes; however, others use a greater number for improved gun performance (see for example U.S. Pat. No. 3,895,253 assigned to the assignee of the present invention).

Because of this distribution of potentials in unipotential type main focus lenses, wherein the potential on an electrode of the main focus lens nearest the rear section is very high, the unipotential gun exhibits a tendency to arc at the interface of the rear section and the main focus lens section. This arcing is attributable to the great difference in potential between the two sections. For example, the electrode of the rear section nearest the main focus lens may have a potential thereon of 1 kilovolt or less, and is commonly displaced a nominal distance of 40 mils from the adjacent electrode of the main focus lens section. The adjacent electrode of the main focus lens may in turn have a potential of 30 kilovolts in present-day, high-brightness tubes. The great difference in potential of nearly 30 kilovolts, coupled with the smallness of the gap, makes the tendency toward arcing all to possible.

A possible solution leading to arc-inhibition would be to increase the inter-electrode gap. However, increasing the gap reduces the prefocusing strength of the electrostatic lens that exists between the two electrodes; also, an increased gap enhances susceptibility of the lens to external aberrating influences.

As is well known in the art, the effect of arcing can be catastrophic in terms of the operability of the television picture display system. Components of the system that can be damaged include power supply circuits; video drivers in color circuits, especially if they comprise transistors and integrated circuits; and the gun itself.

The result has been that, as operating voltages have increased in response to the consumer demand for greater picture brightness, the unipotential focus lens, with its inherent arcing tendencies, has fallen into relative disuse in favor of the bipotential focus lens. This despite the fact that the unipotential lens, and especially the extended-field-type lens, offers performance superior to the bipotential lens, especially with regard to the reduction of spherical aberration.

U.S. Pat. No. 3,863,091 to Hurukawa discloses a unipotential-type main focus lens system having an additional focus electrode disposed nearest the accelerating grid. The stated purpose of the additional electrode, in combination with the other electrodes of the main focus lens, is to form at least two separate electrostatic focusing lens fields, which in turn form a unitary lens having a large aperture. The purpose is said to be the provision of smaller focusing spots and improved focusing characteristics.

In U.S. Pat. No. 3,558,954 to Lilley, an arc-suppression apparatus for a unipotential type gun is disclosed comprising a low-voltage suppressor ring of wire surrounding and spaced outwardly from and disposed substantially in the beam-accelerating gap between the adjacent low-and high-voltage electrodes. The purpose is said to be to shield the external surfaces of the low-voltage electrodes from the high electric fields of the first high voltage electrodes.

OTHER PRIOR ART

U.S. Pat. Nos: 2,227,034, Schlesinger; 3,702,950, Nakamura; 2,931,937, Dufour; 2,971,118, Burdick;

3,090,882, Benway; 3,411,029, Karr; 3,732,457, Ueno et al.

OBJECTS OF THE INVENTION

It is a general object of this invention to provide a television picture tube electron gun having a unipotential-type focus lens, the tendency of which toward destructive electrical arcing is markedly reduced compared with prior art unipotential guns;

It is another object to provide in an electron gun having a unipotential beam focus lens arc-inhibiting means that can be adapted to existing designs of unipotential electron guns with relative simplicity, and with a minimum increase in manufacturing costs.

BRIEF DESCRIPTION OF THE DRAWINGS

The features of the invention which are believed to be novel are set forth with particularity in the appended claims. The invention, together with further objects and advantages thereof, may best be understood, however, by reference to the following description taken in conjunction with the accompanying drawings, in the several figures of which like reference numerals identify like elements, and in which:

DESCRIPTION OF THE PREFERRED EMBODIMENT

Figure 4:
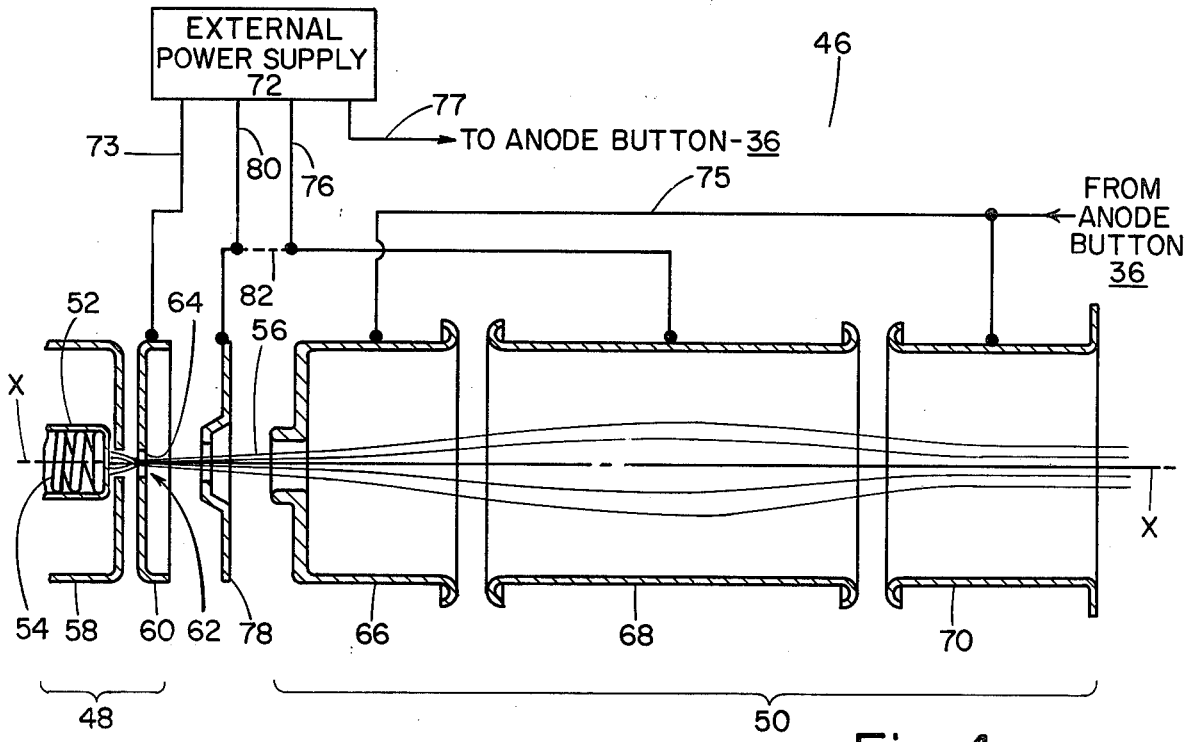
FIG. 4 is an enlarged sectional side view of a typical unipotential-type electron gun having an arc-inhibiting electrode representing a preferred embodiment of this invention.
Figure 5:
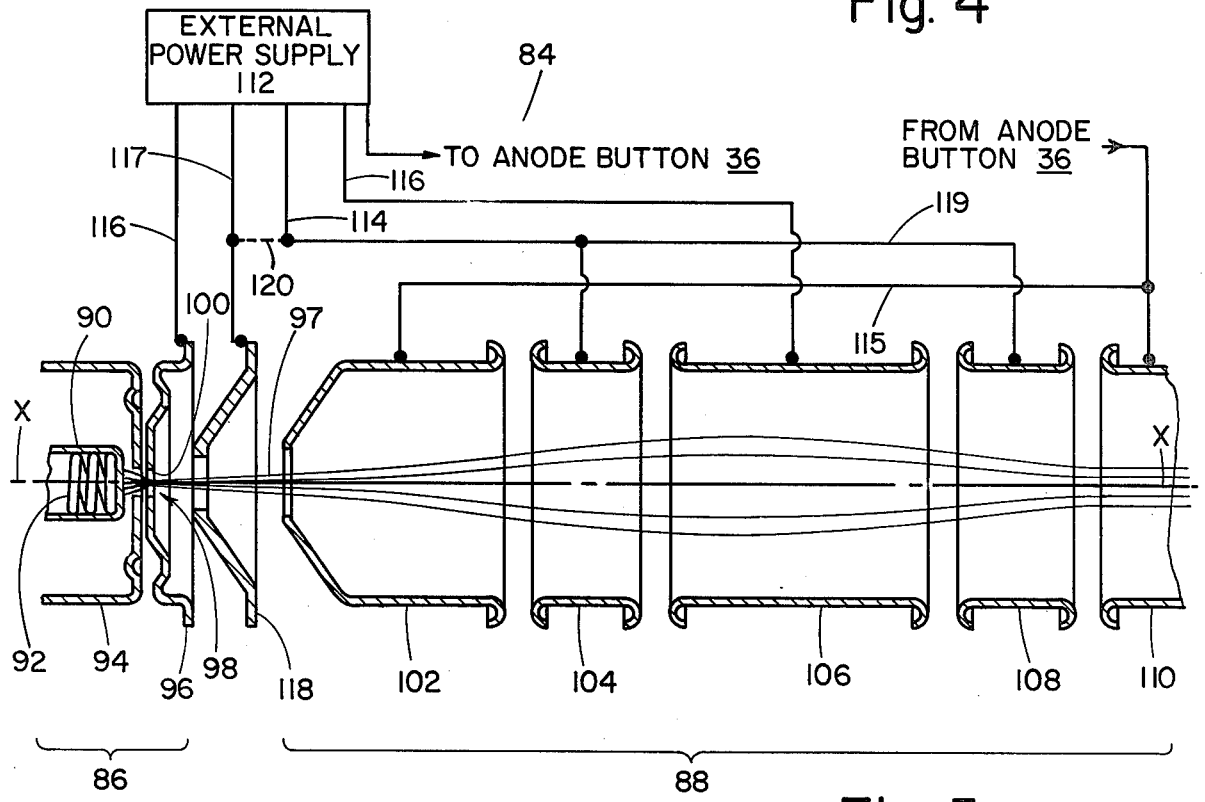
FIG. 5 is an enlarged sectional side view of an electron gun having an extended field electrostatic focus lens with an arc-inhibiting electrode according to this invention.

Whereas the invention can be embodied in electron gun structures of many different unipotential types, preferred embodiments of the principles of this invention are illustrated in FIGS. 4 and 5.

Figure 1:
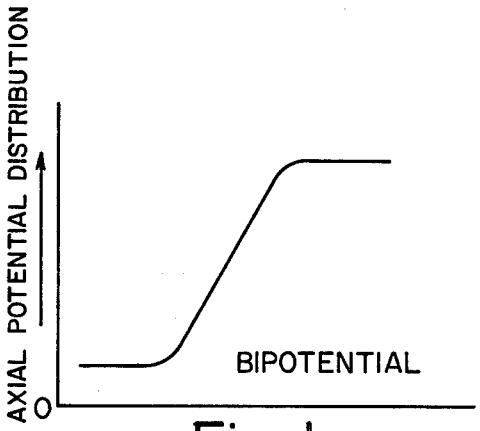
Fig. 1 PRIOR ART
FIG. 1 is a diagrammatical representation of axial potential distribution-versus-length of a bipotential main focus lens structure.
Figure 2:
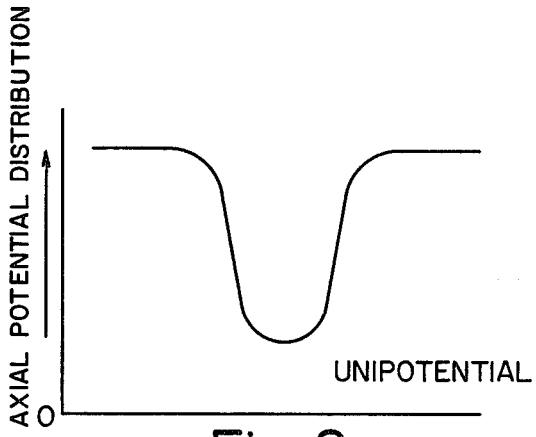
Fig. 2 PRIOR ART
FIG. 2 is a diagrammatical representation of axial potential distribution-versus-length of a unipotential main focus lens structure.
Figure 3:
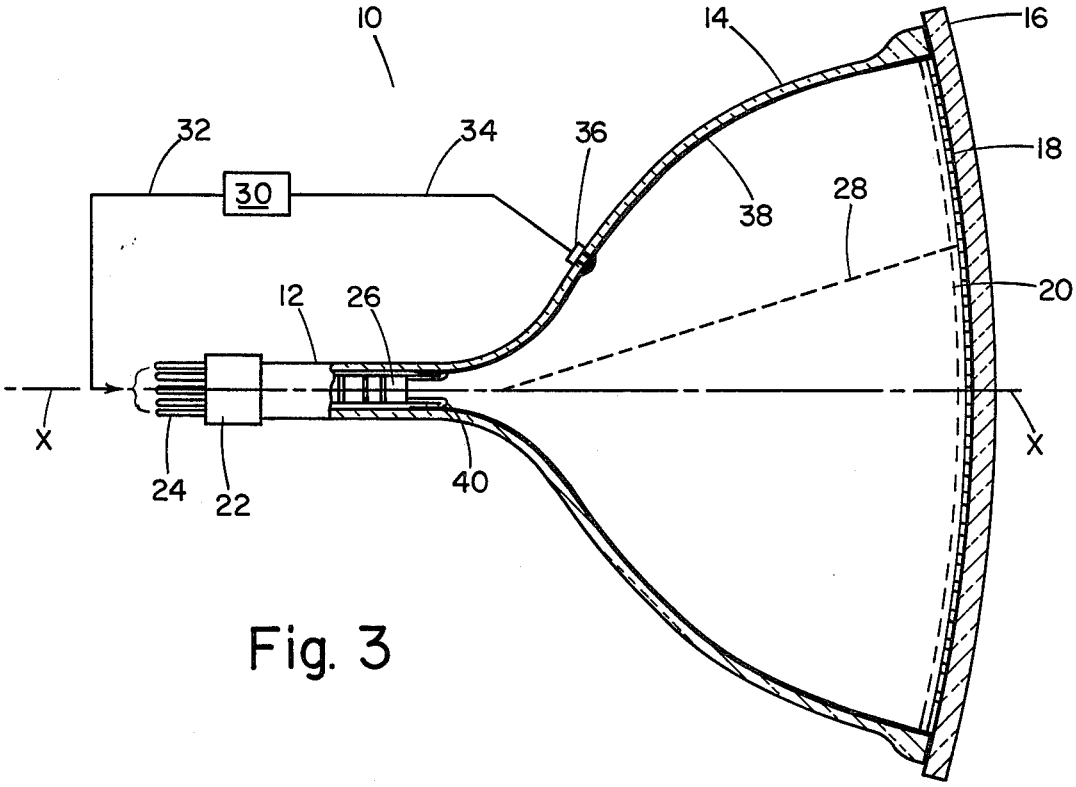
FIG. 3 is a sectional view of a typical color television picture tube envelope in relation to an electron gun having an arc-inhibiting electrode according to the invention.

The relationship of the preferred electron gun embodiments to a television picture tube is shown by FIG. 3. The primary components of a picture tube 10 comprise an evacuated envelope including a neck 12, a funnel 14 and a faceplate 16. On an inner surface of the faceplate 16 is deposited a cathodo-luminescent phosphor 18. In a monochrome picture display tube, the phosphor usually comprises an homogeneous coating. In a color display tube, the coating of phosphor may comprise a pattern of groups of red-light-emitting, green-light-emitting, and blue-light-emitting dots or stripes. A perforated mask 20 is commonly used in a color display for color selection. A tube base 22 incorporates means for the evacuation of air from the envelope of picture tube 10. Base 22 also provides entrance means for a plurality of electrically conductive lead-in pins 24.

An electron gun 26, illustrated schematically, is disposed within the neck 12 substantially as shown. Electron gun 26 is commonly installed in axial alignment with a center line x—x of picture tube 10. Gun 26 emits an electron beam 28 to selectively activate discrete areas of the coating of phosphors 18.

Power supply 30, also shown schematically, provides lower voltages in the range of kilovolts for operation of electron gun 26 through a plurality of leads represented schematically by 32, which enter the envelope of tube 10 through the plurality of lead-in pins 24 in base 22. The voltages for operation of electron gun 26 include those for energizing the filament and a predetermined range of voltages for application to the grids and electrodes of gun 26. Higher voltage for electron gun operation; that is, voltage in the range of 30 kilovolts for the anOdes is indirectly suppled to gun 26 through lead 34, which is connected to anode button 36. Anode button 36 in turn feeds the high voltage through the glass envelope of funnel 14, making contact with a thin, electrically conductive coating 38 disposed on the inner surface of funnel 14, and part way into neck 12. The electrode of gun 26 nearest the faceplate 16 receives the high voltage through a plurality of metallic gun centering springs 40 extending from gun 26 and in physical contact with conductive coating 38.

Referring now to FIGS. 4 and 5, which represent preferred embodiments of the invention, two electron gun structures are shown. The gun illustrated by FIG. 4 has a unipotential-type main focus lens, and the gun illustrated by FIG. 5 has an extended field unipotential-type main focus lens. Either of these guns may be utilized as a single unit to project a single electron beam as in a monochrome television picture display wherein only one electron beam is required; or, either of the guns shown may comprise a component of multiple gun array in trigonal, or in-line configuration, for television color picture tube displays. In this disclosure, the guns are shown and described as single, discrete units, with the understanding that when they are used in multi-gun arrays, the operation of each discrete gun is substantially identical.

With reference now to FIG. 4, there is illustrated a preferred embodiment of this invention wherein electron gun 46 comprised of coaxial and contiguously disposed electrodes, is shown as being in two distinct but closely associated sections comprising rear section 48 and main focus lens section 50. Rear section 48 is comprised of thermionic cathode 52 which is heated by resistive filament 54 to release electrons. As a result of the cooperation of cathode 52, a control grid 58, and an accelerating grid 60, a beam cross-over 62 is formed within or near the aperture 64 of accelerating grid 60. As will be shown, this cross-over is in turn imaged on the faceplate of the television picture tube by an electrostatic focus lens. A change of potential on control grid 58 in relation to cathode 52 results in the intensity modulation of beam 56. To achieve an adequate density of electron emission from cathode 52, accelerating grid 60 may for example have a potential of 1 kilovolt conducted from power supply 72 by lead 73.

The electrostatic focus lens comprises main focus lens section 50. Main focus lens section 50, which is shown as being a standard three-element unipotential lens, is comprised of first electrode 66, second electrode 68 and third electrode 70. Each of the electrodes, which may be spaced apart a nominal distance of about 40 mils, has a potential thereon which is different from an adjacent electrode. Third electrode 70 of main focus lens section 50 may have a potential, for example, of 30 kilovolts supplied indirectly by external power supply 72 through anode button 36, as heretofore described. Second electrode 68 may have a relatively intermediate potential supplied directly by external power supply 72 of, for example, 9 kilovolts as supplied through lead 76. First electrode 66 may have a potential identical to that of third electrode 70 supplied through internal lead 75 that is, 30 kilovolts. As explained, the designation for a lens having this distribution of potentials is "unipotential," wherein the distribution is substantially saddle-shaped, and in which the potentials on the first electrode 66 and the third electrode 70 are essentially equal.

The portion of the electron gun 46 described in the foregoing comprises a standard unipotential gun having a three-section main focus lens. As noted, while the unipotential lens has achieved some commercial success, this type of lens has manifested a drawback in the form of an inherent tendency toward destructive arcing.

In accordance with this invention, an arc-inhibiting electrode 78 is provided between the last electrode (accelerating grid 60) of rear section 48, and the first electrode 66 of main focus lens section 50. Although only one is shown, more than one such electrode may be provided, as necessary. Arc-inhibiting electrode 78 has a potential thereon that is intermediate to the disparate potentials on accelerating grid 60 and first electrode 66 to provide an arc-inhibiting voltage gradient between the two electrodes to reduce the tendency toward destructive arcing. This intermediate voltage is shown as being supplied by power supply 72 through lead 80. An example of a suitable potential intermediate to the potential on accelerating grid 60 (1 kilovolt, e.g.) and the potential on first electrode 66 (30 kilovolts, e.g.) is 14.5 kilovolts.

It is recognized that it is difficult to introduce a separate, additional high voltage into the tube envelope through the base 22, especially a potential of a magnitude of 14.5 kilovolts. As a result, it is entirely possible, and within the scope of this invention, to reduce the potential on arc-inhibiting electrode 78 from 14.5 kilovolts to 9 kilovolts for example, which is the same voltage applied to second electrode 68. This reduction can be accomplished eliminating lead 80 that links power supply 70 to arc-inhibiting electrode 78, and electrically connecting arc-inhibiting electrode 78 to second electrode 68 through dotted lead 82. This substantially intermediate potential has been found to be adequate to attain the objective of providing an arc-inhibiting voltage gradient between the last electrode of rear section 48 and the first electrode of main focus lens section 50; that is, accelerating grid 60 and first electrode 66.

With regard to gap spacing between arc-inhibiting electrode 78 and the adjacent electrodes accelerating grid 60 and first electrode 66, gaps ranging from 30 to 40 mils have been found to provide adequate physical isolation to inhibit arcing between electrodes 60, 78, and 66.

As the result of an introduction of the arc-inhibiting electrode into the gun structure, the tendency toward destructive arcing, and the severity of any arcing is reduced by reducing the potentials between adjacent electrodes, thus providing an arc-inhibiting voltage gradient. This reduction also has the effect of reducing the energy of charged particles (electrons, ions etc.) that may be accelerated between such electrodes during events preceding possible arc initiation. Also, if an arc does occur, the arc-inhibiting electrode electrically and physically shields the electrodes nearest the cathode from particles and fields associated with the arc. As a result, the cathode is provided with a measure of protection from an arc occurring in other regions of the gun structure.

The inventive concept represented by the arc-inhibiting electrode is equally applicable to other types of electron guns with unipotential-type main focus lenses wherein there exist widely disparate potentials on adjacent ones of the electrodes of the rear section and main focus lens section. An example of such a gun to which this invention is applicable is described in U.S. Pat. No. 3,895,253, titled "Electron Gun Having Extended Field Electrostatic Focus Lens." This patent is assigned to the assignee of the present invention. Reference to the patent is recommended for a complete understanding of the electron gun having an extended field electrostatic focus lens. However, for an immediate understanding of the application of an arc-inhibiting electrode to this gun, a brief summary description is provided in the following, with reference to the preferred embodiment shown by FIG 5.

Electron gun 84 is shown as being made up of two distinct but closely associated sections comprising a rear section 86 and a main focus lens section 88. The electrodes of electron gun 84 are coaxial and contiguously disposed.

The elements of rear section 86 are similar to those described for the preferred embodiment shown by FIG. 4, comprising a thermionic cathode 90 caused to emit electrons by the heating of resistive filament 92; also, a control grid 94, and an accelerating grid 96. Electrons emitted by cathode 90 are formed into a modulated beam 97 by control grid 94 and accelerating grid 96. A beam cross-over 98 is formed within or near aperture 100 of accelerating grid 96. The image of cross-over 98 is formed on a viewing screen of the picture tube by the action of main focus lens section 88.

Main focus lens section 88 of electron gun 84 includes first, second, third, fourth and fifth hollow cylindrical electrodes 102, 104, 106, 108, 110. The electrodes are impressed with potentials which progressively increase from a relatively low potential on the center (third electrode 106) to a relatively high potential on the end electrodes (first and fifth electrodes 102 and 110).

The potentials are shown as being applied by external power supply 112 through a plurality of electrical conductors which may enter the tube envelope through the aforedescribed tube base 22 and associated lead-in pins 24, or through an anode button 36, as heretofore described. A potential of 30 kilovolts for example enters the tube envelope through anode button 36 and is conducted to first electrode 102 and fifth electrode 110, which are shown as being electrically connected by internal lead 115. As a result, first electrode 102 also has a potential thereon of substantially 30 kilovolts. Second electrode 104 and fourth electrode 108 are electrically connected by internal lead 119, receiving a potential of 11 kilovolts or lower to 18 kilovolts or higher from power supply 112 through lead 114. A relatively low potential is impressed upon third electrode 106, which may for example receive a potential of 6 to 10 kilovolts from power supply 112 through lead 116.

The configuration of the main focus lens section 88 as described, together with the sequence of potentials impressed upon each of the electrodes, provides an electron lens having reduced spherical aberration when compared with prior art electrostatic lenses having similar diameter. As set forth in U.S. Pat. No. 3,895,253, the lens establishes an essentially saddle-shaped axial potential distribution to provide an axially continuously active, stray-field isolated focusing field for forming an image of the cross-over on a viewing screen of the picture tube.

Referring again to FIG. 5, external power supply 112 supplies a nominal 1 kilovolt potential to accelerating grid 96 through lead 116. As a result, there exists widely disparate potentials with a potential difference in the range of tens of kilovolts between the last of the electrodes of rear section 86, that is, accelerating grid 96, and the first of the electrodes of main focus lens section 88; that is, first electrode 102. Accelerating grid 96 may have a nominal potential of 1 kilovolt thereon, while first electrode 102 may have a nominal potential of 30 kilovolts. This wide disparity is sufficient to induce destructive arcing between these two electrodes. The preferred embodiment of the invention shown by FIG. 5 comprises an arc-inhibiting electrode 118 disposed between the last electrode of rear section 86 and the first electrode of main focus lens section 88. The potential on arc-inhibiting electrode 118 is preferably intermediate to the potentials on accelerating grid 96 and first electrode 102; for example, 14.5 kilovolts. However, as explained, such exactitude of intermediacy is not a requisite in that a considerable range of substantially intermediate potentials can provide an adequate arc-inhibiting voltage gradient between said last and first electrodes. This range can be supplied by disconnecting lead 117 and connecting lead 114 to arc-inhibiting electrode 118 through lead 120 thus carrying potentials in the range of 11 kilovolts or lower to 18 kilovolts or higher directly to arc-inhibiting electrode 118, as shown by dotted lead 120. By this expedient, the need to introduce another separate high voltage lead into the picture tube envelope is made unnecessary. The range of voltages cited, that is, nominally 11 to 18 kilovolts, is deemed adequate to supply a practical arc-inhibiting voltage gradient between accelerating grid 96 and first electrode 102.

With regard to the construction of the electron guns that represent the preferred embodiments of this invention, techniques well known to the art can be used. For example, the electrodes comprising the electron guns illustrated by FIGS. 4 and 5 may be constructed of conventional tubular stock with a common inner diameter. The several electrodes are arranged coaxially with apppropriate gaps in the range of 30 to 40 mils. The electrodes comprising the guns can be supported by well-known means such as a plurality of elongated glass beads located on opposite sides of the electrodes, with attachment to the electrodes by means of a plurality of "claws" extending from the electrodes and embedded into the glass of the beads. The material from which the electrodes may be fabricated is, for example, a stainless steel AISI type 305 strip having a nominal thickness of 10 mils.

Other changes may be made in the above-described apparatus without departing from the true spirit and scope of the invention herein involved, and it is intended that the subject matter in the above depiction shall be interpreted as illustrative and not in a limiting sense.

What is claimed is:

1. For use in a television cathode ray tube having associated therewith a power supply for developing discrete supply voltages, an electron gun for receiving supply voltages from the power supply to produce a focused beam of electrons, comprising:

electron source means comprising cathode means and grid means; and focus lens means for receiving electrons from said electron source means and a predetermined pattern of supply voltages from the power supply to form an electron spot at a distance from said electron source, comprising:

initial and final tubular end electrodes for receiving relatively high supply voltages;

a low voltage tubular electrode located between said initial and final electrodes for receiving a relatively low supply voltage; and, intermediate voltage electrode means between said low voltage electrode and at least one of said end electrodes for receiving a relatively intermediate supply voltage, said lens establishing an extended, axially continuously active focusing field which is substantially shielded from external field disturbances and establishing an axial potential distribution which decreases steady in value from said initial end electrode to said low voltage electrode and increases steadily in value from said low voltage electrode to said final end electrode;

wherein said grid means receives an applied potential of such value that there exists a potential difference in the range of tens of kilovolts across the gap between said grid means and said initial end electrode of said focus lens means, said potential difference being sufficient to introduce a tendency towards destructive arcing between said grid means and said initial end electrode, said gun being characterized by having at least one arc-inhibiting electrode disposed between said grid means and said initial end electrode, and having a potential thereon that is intermediate to said potentials applied to said grid means and to said initial end electrode to provide an arc-inhibiting voltage gradient between said grid means and said initial end electrode.

* * * * *